US005957676A

United States Patent [19]

Peeters

[11] Patent Number: 5,957,676

[45] Date of Patent: Sep. 28, 1999

[54] ROTARY COMPRESSOR WITH WATER MISCIBLE LUBRICANT

[75] Inventor: Guido Peeters, Antwerp, Belgium

[73] Assignee: Atlas Copco Airpower Naamloze Vennootschap, Wilrijk, Belgium

[21] Appl. No.: 08/878,942

[22] Filed: Jun. 19, 1997

[30] Foreign Application Priority Data

Jun. 19, 1996 [BE] Belgium ..... 09600564

[51] Int. Cl.[6] ..... F04C 29/02

[52] U.S. Cl. ..... 418/1; 418/97; 184/6.16

[58] Field of Search ..... 418/1, 88, 97, 418/99, 104, DIG. 1; 184/6.16, 6.24

[56] References Cited

U.S. PATENT DOCUMENTS 4,267,064 5/1981 Sasaki et al. ..... 252/68
4,968,231 11/1990 Zimmern et al. ..... 418/97
5,028,220 7/1991 Holdsworth ..... 418/2
5,408,839 4/1995 Kitaichi et al. ..... 418/179

FOREIGN PATENT DOCUMENTS 818300 8/1959 United Kingdom .
894850 4/1962 United Kingdom .

*Primary Examiner*—John J. Vrablik
*Attorney, Agent, or Firm*—Bacon & Thomas, PLLC

[57] ABSTRACT

Rotary compressor including at least one rotor (2), which is rotatably mounted in a compression chamber (1) by liquid lubricated bearings (4), a device (13-15-16) for injecting water into the compression chamber, and a supply device for supplying (1) a liquid based on polyalkylene glycol miscible with water as the bearing lubricant.

17 Claims, 1 Drawing Sheet

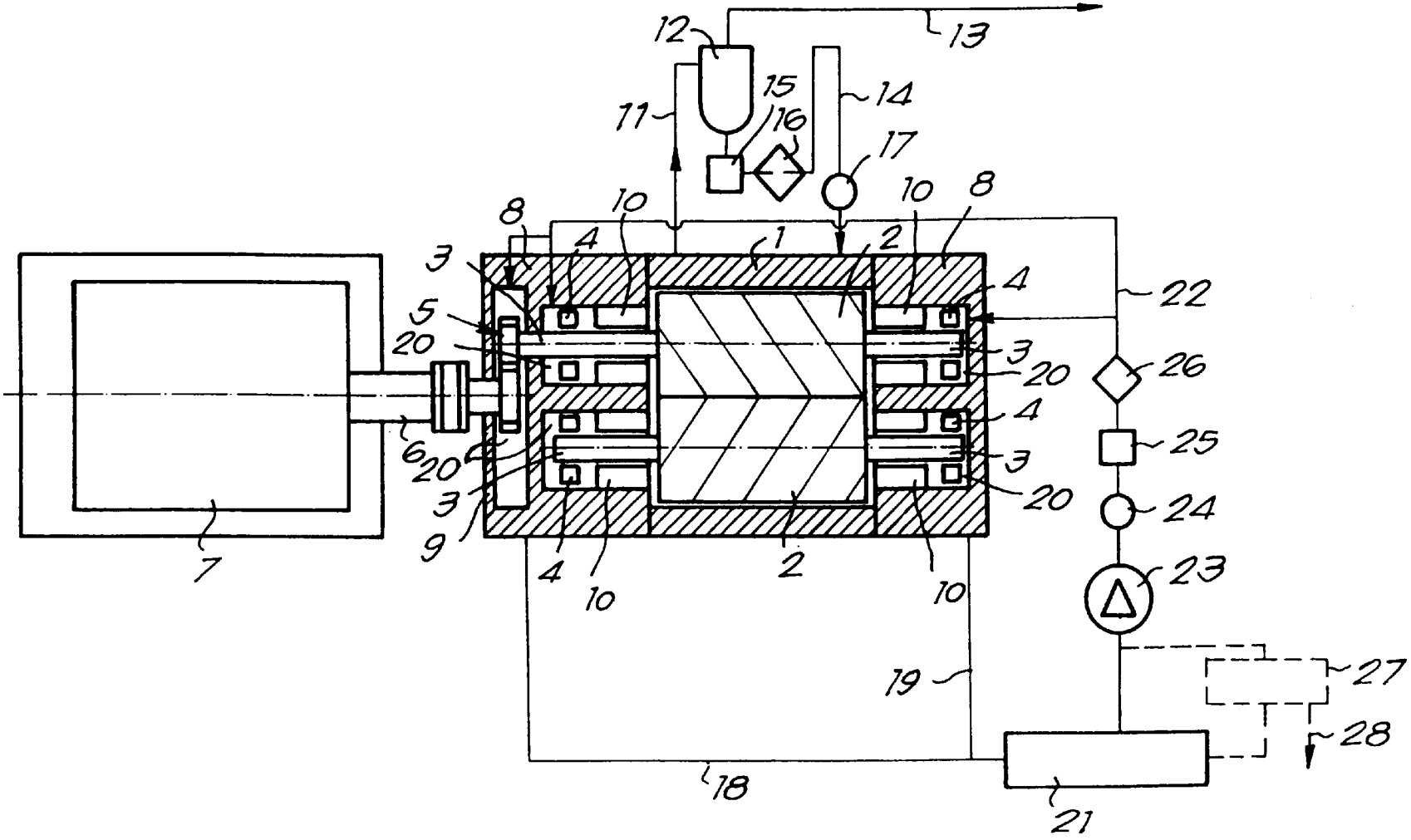
1
2
3
4
5
6
7
8
9
10
11
12
13
14
15
16
17
18
19
20
21
22
23
24
25
26
27
28

ROTARY COMPRESSOR WITH WATER MISCIBLE LUBRICANT

BACKGROUND OF THE INVENTION

1. Field of the Invention

The invention concerns a rotary compressor, comprising at least one rotor, which is rotatably mounted in a compression chamber by liquid lubricated greased bearings, and means to inject water on the rotor in the compression chamber.

2. Description of the Related Art

Rotary compressors, in particular screw compressors using two screws as rotors, are often used because of their excellent output and reliability. They deliver almost pulseless compressed air and require little maintenance.

Oil-injected compressors are preferred to the more expensive dry rotating compressors, unless oil-free compressed air is required.

Dry rotating compressors use oil as lubricant solely for the bearings and possibly for the gear box. These compressors can only render oil-free compressed air if the compression chamber is carefully sealed to avoid oil leakage from the bearings to the compression space, which requires complicated and expensive seals.

With oil-injected compressors, oil is injected in the compression chamber so that the oil provides the required lubrication of the moving parts and acts as a coolant. A thin oil layer creates a liquid seal between the rotors and between the walls of the compression chamber and the rotors. In such way, the blow-by of compressed air is reduced, the output is increased and the working temperature is reduced, thereby increasing thermodynamic efficiency.

A drawback of these known oil-injected compressors is, however, the presence of oil traces in the compressed air.

Oil contamination can partly be reduced by means of oil separators and filters; however, only by using complex filtering systems can clean air be obtained.

Filters, in particular the complex filtering systems, are expensive, maintenance intensive, energy absorbing, unreliable and cause a pressure drop.

In practice, fully oil-free compressed air is difficult to obtain in an economically acceptable way with oil-injected compressors.

Therefore, alternative lubricant means other than oil have been investigated.

It is known to replace injected oil in the compression chamber by silicones, more particularly polydimethylsiloxanes.

Nevertheless, these substances have an oily character and are not soluble in water. The removal of traces of silicones from the compressed air is of the same difficult nature as with oil-injected compressors. Complex filtering systems are also required so that silicone-free compressed air cannot be obtained in an economically acceptable way.

In certain applications, compressed air including silicones is not allowed at all. The rather elevated surface activity of the polysiloxane molecules reduces the quality and adhesion of coatings of paints and lacquers that are sprayed with compressed air contaminated with even minimal quantities of silicones.

In compressors used for the compression of hydrocarbons such as ethylene, use of a liquid lubricant composed of polyalkylene glycols which can be mixed with oil is already known.

The solubility of hydrocarbons in these glycols is, however, much smaller than in mineral oils. The solution of hydrocarbons in the mineral oils reduces viscosity, resulting in insufficient lubrication and untimely abrasion.

Polyalkylene glycols do not exhibit this drawback and still are considered oily liquids.

Such glycols have been tested as liquid lubricants for air-compressors. Considering their cost and that traces thereof in the compressed air cannot be tolerated for may applications, their use in air-compressors has not been further developed.

In an attempt to produce oil-free air, compressors have been developed in which water is injected in the compression chamber and oil is used only for the lubrication of the bearings and the gear box.

However, such compressors do have to be provided with reliable and complex seals between the compression chamber and the bearings and gear box. This results in an elevated cost. The usual simple seals cannot be used since leaking oil into the compression chamber reduces the quality of the compressed air and water-leakage in the bearings and possibly in the gear box is detrimental to lubrication and produces corrosion, decreasing the life of the bearings and possibly the gears.

Of course, bearings and gears can be made out of non-corroding high performance materials such as special steel alloys or ceramic materials. Such materials solve the problem of corrosion but are not an appropriate solution to obtain a good tribologically functioning system. Moreover, the cost of such a compressor is considerable.

The aim of the invention is to remedy these drawbacks and to provide a water-injected rotary compressor at a comparatively low price which is long-lasting and produces oil-free compressed air or other fluid.

SUMMARY OF THE INVENTION

This aim according to the invention is realized by using a liquid based on polyalklene glycols miscible with water as liquid lubricant for the bearings.

Considering that small leakages of water into polyalklene glycols are acceptable without being detrimental to the lubricant, relatively simple and consequently cheap seals can be used in the compressor.

Preferably, the liquid lubricant is composed of at least 68 weight %, and still more preferably at least 80 weight %, polyalklene glycol miscible with water.

The polyalklene glycol can consist of up to 30 weight % water and a small quantity of additives.

The remainder of the macromolecules of polyalklene glycol can consist of alkyl ether groups derived from one or more of the following base materials: propylene oxide, butylene oxide, 1,2 alkylene oxides with long chains and tetraydrofurane.

Preferably, the polyalkylene glycol contains at least 40 mol % ethylene-ether groups, derived from ethylene-oxide as base material, in the macromolecules.

In a particular embodiment of the invention, the compressor comprises a closed separate circuit for the polyalkylene glycol liquid lubricant in which a pump is mounted.

Preferably, means for removing accumulating water from the polyalkylene glycol is connected to the circuit.

BRIEF DESCRIPTION OF THE DRAWINGS

To better show the characteristics of the invention, a preferred embodiment of a rotary compressor according to the invention is shown hereinafter as an example, without any restrictive character, with reference to the accompanying drawing which outlines a section of a compressor according to the invention.

DETAILED DESCRIPTION OF THE PREFERRED EMBODIMENT

The compressor, as shown in the drawing, is composed of a compression chamber 1 in which two cooperating rotors 2 with their shafts 3 are mounted by means of bearings 4.

One of shafts 3 is activated at its extremity. This can be realized, for example, by means of a gear transmission 5 connected to a shaft 6 of an electric motor 7. Activating rotor 2 activates the other rotor 2.

Bearings 4 are mounted in end walls 8 of compression chamber 1. Gear transmission 5 is mounted in a gear box 9 which is connected to an end wall 8 or integrated in an end wall 8. In end walls 8, seals 10 are fitted around shafts 3 between bearings 4 and rotors 2.

Compression chamber 1 is linked with an outlet-pipe 11 for receiving a mixture of air and water which flows into a water separator 12. The air is further conducted via a conduit-pipe 13. Separated water, via conduit-pipe 14 connected to a refrigerating element 15, a filter 16 and a restriction element 17, is injected between the rotors 2 in compression chamber 1.

While lubrication, sealing and cooling of rotors 2 in compression chamber 1 is realized by means of the injected water, lubrication of bearings 4 and gear transmission 5 is accomplished by means of polyalkylene glycol miscible with water. The polyalkylene glycol contains at least 40 mol % ethylene ether groups, derived form ethylene oxide as a starting material, in the macromolecules.

The remainder of the macromolecules is preferably formed by other alkyl ether groups derived from propylene oxide, butylene oxide, 1,2 alkylene oxide with long chain or tetrahydrofurane as a starting material.

Because the liquid lubricant for bearings 4 and gear transmission 5 is miscible with the water which is injected via conduit-pipe 14 onto the rotors 2 in compression chamber 1, a limited leakage through seals 10 is acceptable so that the seals may be of a simple, possibly known, type.

The seals can, for instance, be simple contactless labyrinth sealings.

The compressor comprises a separate closed circuit for the polyalkylene glycol for lubrication of bearings 4 and gear transmission 5. The circuit comprises conduit-pipes 18 and 19 which are linked on both sides of the compression chamber 1 with spaces 20 within bearings 4 and gear box 9. A supply-tank 21, into which conduit-pipes 18 and 19 flow, and a supply-conduit 22, which returns from supply tank 21 back to spaces 20, are included in the circuit as well. A pump 23, a pressure regulator 24, a refrigerating element 25 and a filter 26 are mounted within supply-conduit 22.

In the closed circuit, an arrangement 27 is provided for separating water from polyalkylene glycol so as to avoid the accumulation of a considerable quantity of water in the polyalkylene glycol which would be detrimental to lubrication. The water can be removed by thermal means, under vacuum or in other ways. Arrangement 27 can be, for instance, an evaporator, a semi-permeable membrane, an adsorption-unit or a combination of them. The separated water is removed via conduit-pipe 28.

Possible water-leakage from compression chamber 1 through seals 10 that reaches bearings 4 is bound by the macromolecules of the polyalkylene glycol, thus avoiding the formation of a separate water-phase.

The hydrated polyalkylene glycol keeps its basic characteristics to a large extent.

This polyalkylene glycol can absorb water without unacceptable loss of lubricating properties up to 10 weight %, and in certain cases up to 20 weight % or even 30 weight %.

Consequently, the obtained compressed air will be totally free from polyalkylene glycol.

The used polyalkylene glycol is preferably biodegradable.

Polyalkylene glycols which work as liquid lubricant are polyalkylene glycols with 40 mol % or more ethylene-ether groups in the macromolecule. More ethylene-ether groups leads to better biodegradable results.

One or more additives can be added to these polyalkylene glycols. Anti-corrosion additives can protect against corrosion resulting from air-oxygen at elevated temperatures. Loading additives such as phosphoric acid esters not only increase the load bearing capacity but also the viscosity/pressure coefficient and reduce abrasion of metal parts.

Polyalkylene glycols miscible with water are the ones which are obtained mainly by alkali-catalyzed polyaddition of petrochemical base molecules such as ethylene oxide, propylene oxide, butylene oxide, 1,2 alkylene oxides with long chain or tetrahydrofurane. The base molecules are bound by ether groups and form homopolymers or copolymers.

Preference is given to the following groups polyalkylene glycols that are soluble in water:

1.- Polyethylene glycols modified by a singular starting molecule of a chemical structure other than ethylene-oxide.

Such polyethylene glycols are, for instance, the PR ranges from HOECHST which in each macromolecule contain one single propylene ether group besides the ethylene-ether groups. Similar glycols are commercialized by DOW CHEMICALS under the name TERRALOX, grades WA-32 and WA-41.

These glycols are quickly biodegradable. Type PR 600 from HOECHST, for instance, is 86% bio-degradable within 28 hours according to the Zahn-Wellens test.

These glycols are mostly obtained by starting the reaction of polyaddition with propylene oxide or butanol, but furthering the forming of the macromolecules with ethylene-oxide. These glycols possess good lubrication properties, have a great load bearing capacity and are quickly biodegradable. The pour points which usually exceed 01° C. with non-modified polyethylene glycols are between −10 and −50° C. with polyethylene glycols modified with one single propylene ether group. This facilitates the starting of the compressor at low temperatures and causes less hydraulic losses.

Hydraulic liquids based on said polyethylene glycols which possibly contain an antioxidant, an anti-corrosion means and possibly other additives are commercialized under the Trademark GENODYN (grades 1791 and 1802) from HOECHST, under the Trademark UKADOL from UK Mineralölwerke Wenzel und Weidmann GmbH, and under the Trademarks FDC 300 and FDC 400 from CARBIDE CORPORATION.

2.- Copolymers from ethylene oxide and propylene oxide containing at least 40 mol % ethylene ether groups.

Such polyalkylene glycols are, for instance, the ones of the B11 ranges from HOECHST which contain about 50 mol % ethylene-oxide and 50 mol % propylene oxide. These glycols have a great load bearing capacity, but a limited biodegradability.

3.- Copolymers from ethylene oxide and other alkylene oxides containing at least 40 mol % ethylene ether groups.

Such glycols initiated with butanol are commercialized under the names SYNALOX 50-50B (with 50 mol % ethylene-oxide groups) and SYNALOX 25-50B (with 75% ethylene oxide groups) from DOW CHEMICALS. Such glycols can be obtained by copolymerization of ethylene oxide with furan or with alkyl-1,2 epoxides with long chain.

4.- Unmodified polyethylene glycols with relative low molecular weight.

Such glycols with a molecular weight up to 600 do have the required viscosity and a good load bearing capacity which can even be ameliorated by adding additives. They are not or hardly toxic and are quickly biodegradable. Their pour point is rather elevated, resulting in a restricted application under the freezing-point.

Solubility in water of polyalkylene glycols that contain 40 or more mol % ethylene oxide groups can be explained by the accessibility of the oxygen of the $-CH_2O$-ether bindings to the water molecule which activates hydrogen bindings. These hydrogen bindings between the water and the free electron pairs of the ether oxygen produce hydrated macromolecules that are miscible with water.

In the case of propylene glycols and copolymers with more than 75 mol % propylene oxide groups, the big methyl groups constitute a stearic bar to the water molecules eliminating hydrogen bindings. The macromolecule is only hydrated on the spots where ethylene oxide bindings are present.

Considering that the thermal movement of the bulky methyl groups increases with growing temperature, the binding of the water molecules to the polyalkylene glycol molecules of ethylene oxide/polyethylene oxide copolymers is weaker with higher temperatures and a loss of water molecules from the hydrated macromolecules takes place. At a determined temperature the reduction of the hydratation degree of the macromolecules is of such capacity that the limit of solubility in water is reached and a visible, reversible phase separation takes place.

At a given temperature, the viscosity of the polyalkylene glycols depends mainly on the molecular weight. The dependence of the viscosity on the temperature, which is the viscosity index, is lower than with mineral oils and is, for instance, situated between 100 and 250.

Since polyalkylene glycols are made out of macromolecules, the vapor pressure is almost non-existing. In the temperature area in which the rotary screw compressors are active (from 50 to 100° C.), most of the polyalkylene glycols are stable so that no volatile components are created. Such glycols with an elevated percentage ethylene oxide groups or tetrahydrofurane remain stable even above 100° C. By the addition of anti-oxidants, such as stearically hindered phenol or phenacetin, the thermal stability can even be increased.

Since polyalkylene glycols under lasting contact can affect upper layers or elastomers, it is preferred to use upper layers based on thermohardening polymers such as epoxy resin or thermohardening commercial paints such as VETRODUR from HOECHST, and elastomers from the following group butadienacrylnitril, polyethylene/polypropylene and silicone.

The viscosity/pressure coefficient, which is an indication of the load bearing capacity of the liquid lubricant under extreme pressure, usually is lower than with mineral oils; however, this load bearing capacity is sufficiently great so that the polyalkylene glycol guarantees appropriate protection of the metals against abrasion. The load bearing capacity of polyalkylene glycol based on copolymerization of ethylene-oxide and propylene oxide is increased in accordance with the quantity of ethylene oxide. Such glycols based on tetrahydrofurane or 1,2 epoxides with long chains do also possess a great load bearing capacity.

The load bearing capacity can even be increased by the addition of additives such as phosphoric acid esters.

Due to the use of polyalkylene glycol that can be mixed with water as liquid lubricant for bearings 4 and gear transmission 5, the water-injected rotary compressor as described hereabove is inexpensive in construction. Seals 10 can be used which may be simple seals, for instance, contactless seals which are particularly long lasting.

Most of the used polyalkylene glycols are not or hardly toxic and the preferred glycols are quickly biodegradable. Injected water accidentally polluted by such polyalkylene glycols can be evacuated without a problem, unlike water polluted with mineral oil.

If by accident water miscible polyalkylene glycols would be drained off in nature, then no separate surface layer will be formed on the water surface which could be considered detrimental to the life in the water. Moreover, the preferred glycols are quickly biodegradable.

The present invention is not limited to the embodiments described hereabove and shown in the drawing, but such rotary compressors can be realized in different variants falling within the scope of the present invention.

In particular, the compressors need not be screw compressors.

Activation of the rotors need not be realized by means of a gear transmission.

From the foregoing it is clear that when the compressor is in use, the water, which may be present in the polyalkylene glycol up to 30 weight %, can be dissolved in this polyalkylene glycol. Therefore, it is possible to start with polyethylene glycol in which a quantity of water is already present, for instance, up to 20 weight %, particularly when a separator for the accumulated water is present.

This separator need not be mounted in the closed circuit of the polyalkylene glycol as described. It can be mounted anywhere else.

The present invention is not exclusively applicable to compressors which produce air pressure. It is evident that the compressor can be used as well for other gaseous fluids in as far that the latter are compatible with water and the liquid lubricant.

I claim:

1. A rotary compressor, comprising a rotor (2) rotatably mounted in a compression chamber (1) by liquid lubricated bearings (4); means (13-15-16) for always injecting substantially only water on the rotor in the compression chamber (1); and means for supplying liquid lubricant to the bearings (4), wherein the liquid lubricant supplied to the bearings (4) comprises polyalkylene glycol miscible with water.

2. Compressor according to claim 1, wherein the liquid lubricant contains at least 68 weight % polyalkylene glycol miscible with water.

3. Compressor according to claim 2, wherein the liquid lubricant contains at least 80 weight % polyalkylene glycol miscible with water.

4. Compressor according to claim 1, wherein the polyalkylene glycol miscible with water contains at least 40 mo. % ethylene ether groups, derived from ethylene oxide as a staring material, in the macromolecules.

5. Compressor according to claim 4, wherein the remainder of the macromolecules of polyalkylene glycol is composed of alkyl ether groups selected from the group of starting materials consisting of propylene oxide, butylene oxide, 1,2 alkylene oxide with a long chain and tetrahydrofurane.

6. Compressor according to claim 1, wherein the liquid lubricant is polyethylene glycol modified by a singular starting molecule having a chemical structure other than ethylene oxide.

7. Compressor according to claim 1, wherein the liquid lubricant is an unmodified polyethylene glycol having a molecular weight lower than 600.

8. Compressor according to claim 1, further comprising: a closed separate circuit (18 to 28) for conveying the polyalkylene glycol liquid lubricant; and a pump (23) mounted in the circuit.

9. Compressor according to claim 8, wherein the circuit (18 to 28) includes a water separator (27) to separate water from the liquid lubricant.

10. A method of lubricating a fluid compressor including a compression chamber and a compressor rotor device in the compression chamber supported for rotation by liquid lubricated bearings adjacent the compression chamber, comprising:

using as a bearing lubricant a liquid based on polyalkylene glycol miscible with water; and always injecting substantially only water into the compression chamber onto the rotor device during compressor operation to lubricate and seal the compression chamber.

11. A method according to claim 10, including using as the bearing lubricant a liquid containing at least 68 weight % polyalkylene glycol miscible with water.

12. A method according to claim 11, including using as the bearing lubricant a liquid containing at least 80 weight % polyalkylene glycol miscible with water.

13. The method according to claim 10, including using as the liquid lubricant a liquid containing polyalkylene glycol containing at least 40 mo. % ethylene ether groups, derived from ethylene oxide as a starting material, in the macromolecule.

14. The method according to claim 13, including using a polyalkylene glycol in which the remainder of the macromolecules of polyalkylene glycol is composed of alkyl ether groups selected from the group of starting materials consisting of propylene oxide, butylene oxide, 1,2-alkylene oxide with a long chain and tetrahydrofurane.

15. The method according to claim 10, including using as the liquid lubricant a liquid containing a polyethylene glycol modified by a singular starting molecule having a chemical structure other than ethylene oxide.

16. The method according to claim 10, including using as the liquid lubricant a liquid containing an unmodified polyethylene glycol having a molecular weight lower than 600.

17. The method according to claim 10, including supplying the bearing lubricant and the water by using separate flow circuits connected to the compressor.

* * * * *